US008448484B2

(12) United States Patent
Huang et al.

(10) Patent No.: US 8,448,484 B2
(45) Date of Patent: May 28, 2013

(54) REKEYABLE LOCK CYLINDER

(75) Inventors: Chao-Ming Huang, Kaohsiung (TW); Chi-Ming Chen, Kaohsiung (TW)

(73) Assignee: Taiwan Fu Hsing Industrial Co., Ltd., Kaohsiung (TW)

( * ) Notice: Subject to any disclaimer, the term of this patent is extended or adjusted under 35 U.S.C. 154(b) by 0 days.

(21) Appl. No.: 13/151,381

(22) Filed: Jun. 2, 2011

(65) Prior Publication Data

US 2011/0226027 A1 Sep. 22, 2011

Related U.S. Application Data

(63) Continuation-in-part of application No. 12/572,937, filed on Oct. 2, 2009, now Pat. No. 7,980,106, which is a continuation-in-part of application No. 12/149,757, filed on May 7, 2008, now Pat. No. 7,624,606.

(51) Int. Cl.
*E05B 27/04* (2006.01)
*E05B 29/04* (2006.01)

(52) U.S. Cl.
USPC ..... 70/383; 70/340; 70/368; 70/384; 70/492; 70/493; 70/495

(58) Field of Classification Search
USPC ..... 70/491–496, 337–343, 368, 382–385, 70/392, 376, 377, DIG. 21, DIG. 22
See application file for complete search history.

(56) References Cited

U.S. PATENT DOCUMENTS 2,155,734 A 4/1939 Olson
3,578,371 A 5/1971 Keller
3,589,153 A 6/1971 Hill
4,376,382 A 3/1983 Raymond et al.
4,966,021 A 10/1990 Boag
5,791,181 A * 8/1998 Sperber et al. ..... 70/383
6,041,631 A 3/2000 Vonlanthen
6,119,495 A * 9/2000 Loreti ..... 70/340
6,860,131 B2 3/2005 Armstrong et al.
7,007,528 B2 * 3/2006 Chong et al. ..... 70/492
7,360,382 B2 4/2008 Fernandez
7,392,677 B1 7/2008 Fan
7,424,815 B1 9/2008 Pagnoncelli
7,448,239 B1 11/2008 Huang et al.
7,448,240 B1 11/2008 Huang et al.
7,526,935 B2 5/2009 Huang et al.
7,624,606 B1 * 12/2009 Huang et al. ..... 70/338
7,628,048 B2 * 12/2009 Huang et al. ..... 70/338
7,634,931 B2 * 12/2009 Segien et al. ..... 70/384

(Continued)

FOREIGN PATENT DOCUMENTS

JP 7197705 A1 8/1995

*Primary Examiner* — Lloyd Gall
(74) *Attorney, Agent, or Firm* — Jackson IPG PLLC

(57) ABSTRACT

A rekeyable lock cylinder comprises a plurality of first rack components, a plurality of second rack components and a guide bar having a first surface engaged with the first rack components. The second rack components are movable via contacting against a first matched key which is inserted in a first direction. The guide bar has a second surface, a first side, a second side, and a tool-receiving portion recessed into the first side. The tool-receiving portion is parallel to the first direction, and the first rack components are actuated by the guide bar via acting force applied by the rekeying tool accommodated in the tool-receiving portion therefore enabling the first rack components to move in a transverse direction relative to the first direction and disengaging the first rack components from the second rack components.

15 Claims, 18 Drawing Sheets

U.S. PATENT DOCUMENTS

| | | | | |
|---|---|---|---|---|
| 7,900,491 | B2 * | 3/2011 | Chong | 70/492 |
| 7,937,976 | B2 * | 5/2011 | Huang et al. | 70/338 |
| 7,980,104 | B1 * | 7/2011 | Huang | 70/338 |
| 7,980,106 | B2 * | 7/2011 | Huang et al. | 70/383 |
| 8,056,378 | B2 * | 11/2011 | Huang et al. | 70/338 |
| 8,161,783 | B2 * | 4/2012 | Huang et al. | 70/492 |
| 2003/0089149 | A1 | 5/2003 | Suzuki et al. | |
| 2004/0069030 | A1 | 4/2004 | Takadama | |
| 2006/0059965 | A1 | 3/2006 | Benstead | |
| 2006/0101880 | A1 | 5/2006 | Ward-Dolkas et al. | |
| 2008/0264127 | A1 | 10/2008 | Chiang et al. | |
| 2008/0307841 | A1 | 12/2008 | Huang et al. | |
| 2009/0277233 | A1 | 11/2009 | Huang et al. | |
| 2011/0154872 | A1 * | 6/2011 | Huang et al. | 70/384 |

* cited by examiner

REKEYABLE LOCK CYLINDER

CROSS REFERENCE TO RELATED APPLICATIONS

This application is a continuation-in-part of U.S. patent application Ser. No. 12/572,937, filed on Oct. 2, 2009, now U.S. Pat. No. 7,980,106, which is a continuation-in-part of U.S. patent application Ser. No. 12/149,757, filed on May 7, 2008, now U.S. Pat. No. 7,624,606, the benefits of which are claimed under 35 U.S.C. §120, and entire contents of which are hereby incorporated by reference.

FIELD OF THE INVENTION

The present invention is generally relating to a lock cylinder, more particularly to a rekeyable lock cylinder.

BACKGROUND OF THE INVENTION

Lock cylinder of known lock device typically is matched with a proper key so lock cylinder as well as key must be replaced in pair while replacing a lock, which results in high lock-replacing cost and inconvenience in use.

SUMMARY

The primary object of the present invention is to provide a rekeyable lock cylinder that comprises a plurality of first rack components, a plurality of second rack components selectively engaged with the first rack components, and a guide bar having a first surface engaged with the first rack components. The second rack components are movable via contacting against a first matched key which is inserted in a first direction. The guide bar has a second surface opposite to the first surface, a first side in connection with the first surface and the second surface, a second side in connection with the first surface and the second surface, and a tool-receiving portion recessed into the first side. The second surface is formed in a smooth shape, the tool-receiving portion is parallel to the first direction, and the first rack components are actuated by said guide bar via acting force applied by a rekeying tool accommodated in the tool-receiving portion therefore enabling the first rack components to move in a transverse direction relative to the first direction and disengaging the first rack components from the second rack components. In this invention, for the reason that the first rack components are actuated by mentioned guide bar via acting force applied by the rekeying tool, the first rack components are capable of moving in a transverse direction relative to the first direction and disengaging from the second rack components. Therefore, via mentioned operation, a rekeying process can be effectively achieved.

DETAILED DESCRIPTION OF THE INVENTION

Figure 1:
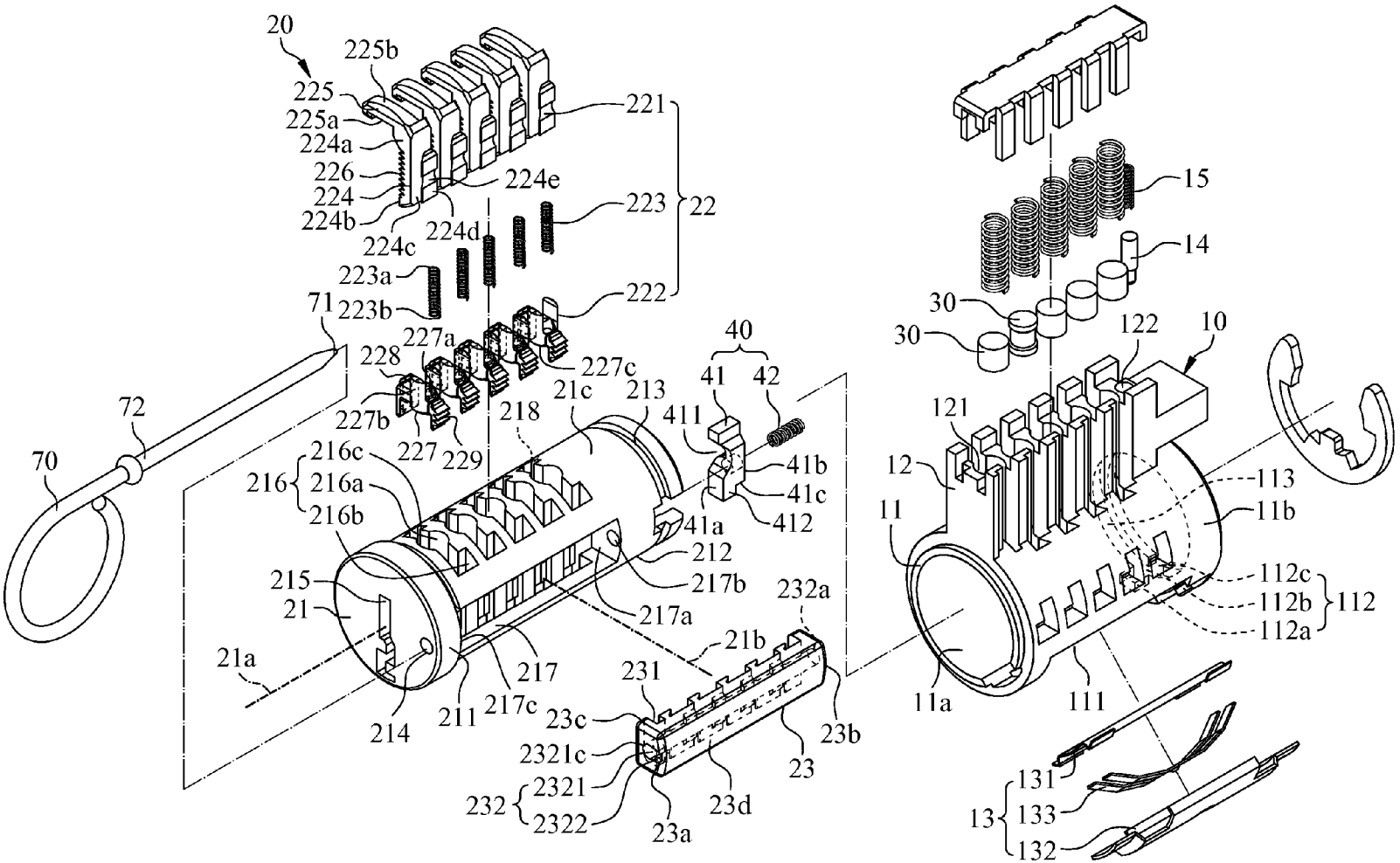
FIG. 1 is an exploded perspective view illustrating a rekeyable lock cylinder in accordance with a preferred embodiment of the present invention.
Figure 1A:
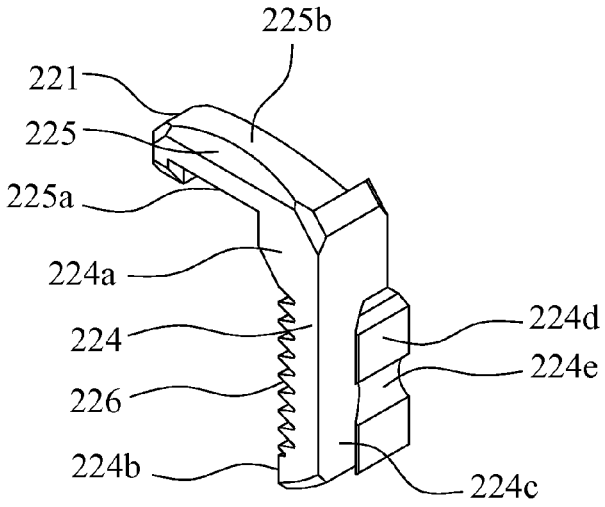
FIGS. 1*a*-1*c* are views of a first rack component for use in accordance with a preferred embodiment of the present invention.
Figure 1B:
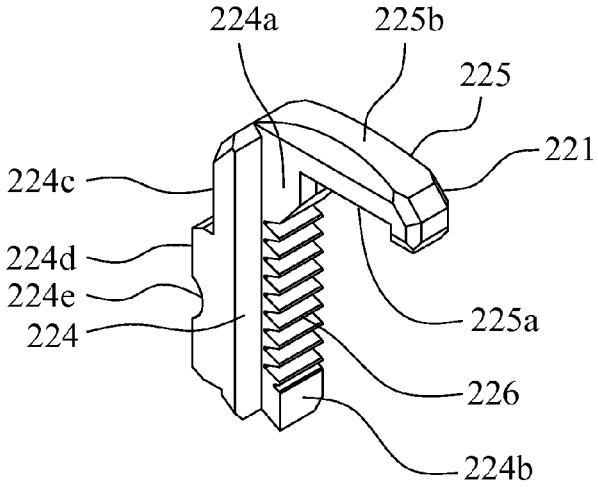
Figure 1C:
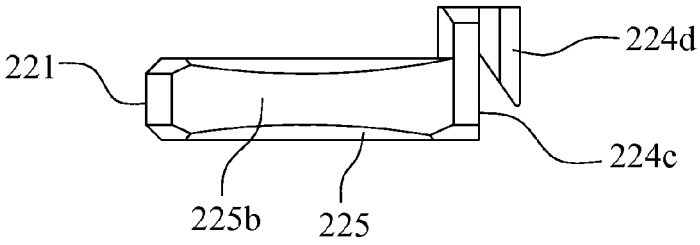
Figure 1D:
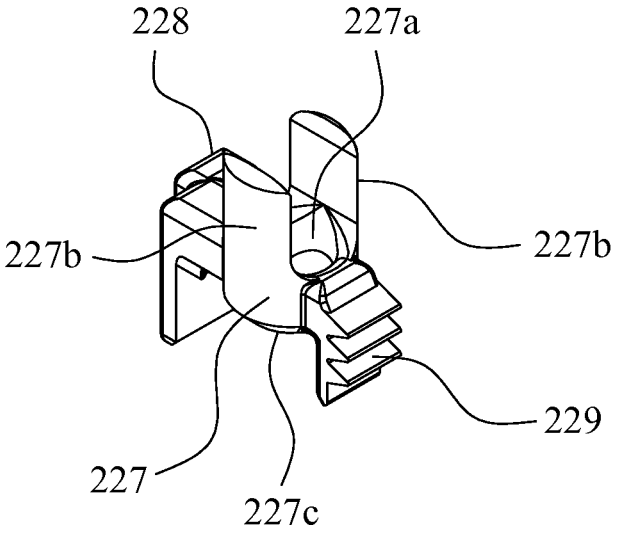
FIGS. 1*d*-1*e* are views of a second rack component for use in accordance with a preferred embodiment of the present invention.
Figure 1E:
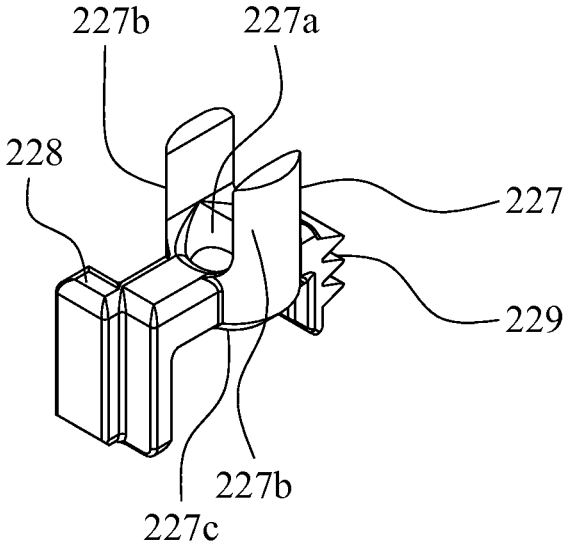
Figure 2:
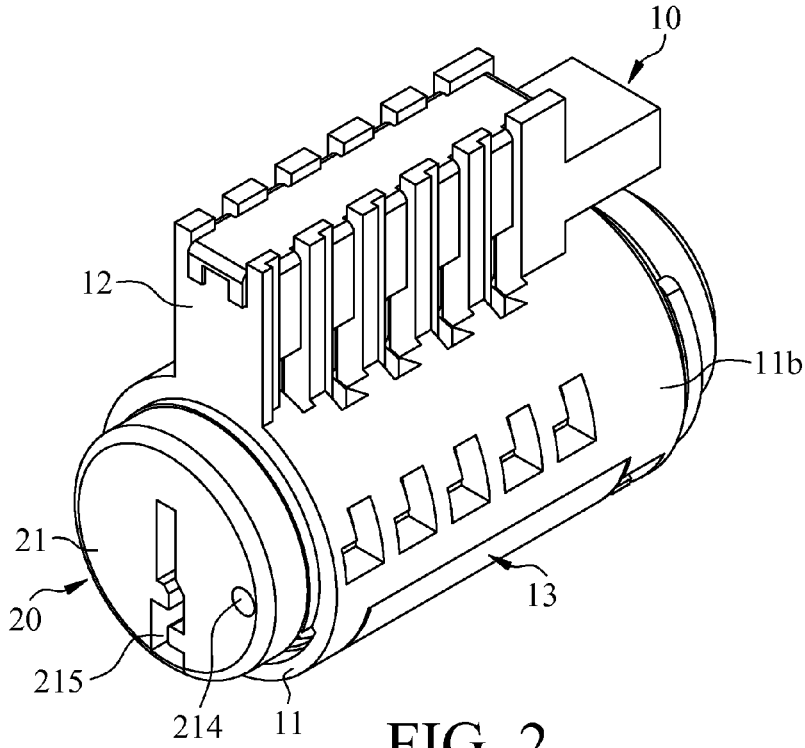
FIG. 2 is an assembled perspective view illustrating the rekeyable lock cylinder in accordance with a preferred embodiment of the present invention.
Figure 3A:
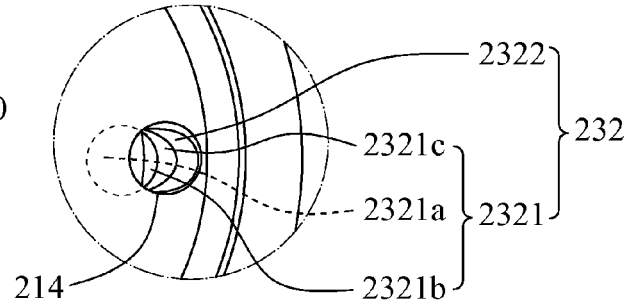
FIG. 3*a* is an enlarged view of the rekeyable lock cylinder of FIG. 3 taken from the encircled dotted line portion of FIG. 3.
Figure 3:
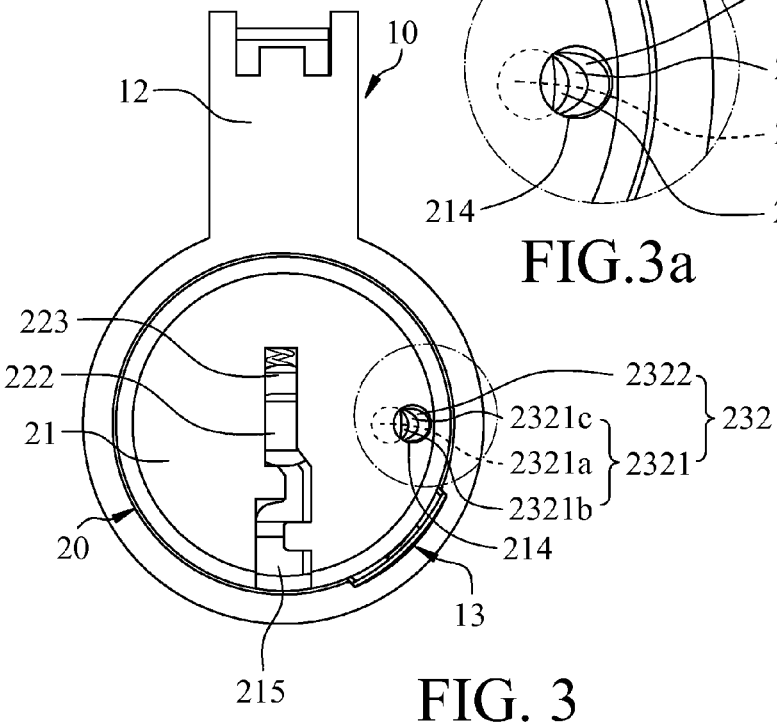
FIG. 3 is a side view illustrating the rekeyable lock cylinder in accordance with a preferred embodiment of the present invention.
Figure 4:
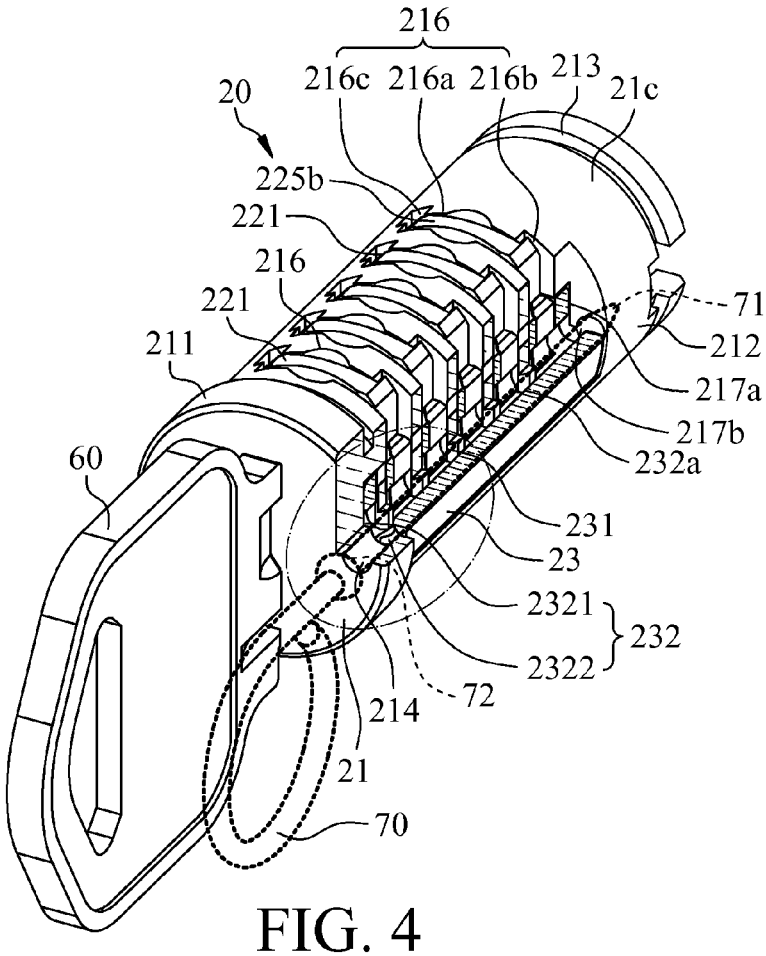
FIG. 4 is an assembled perspective view illustrating a plug assembly in accordance with a preferred embodiment of the present invention.
Figure 9:
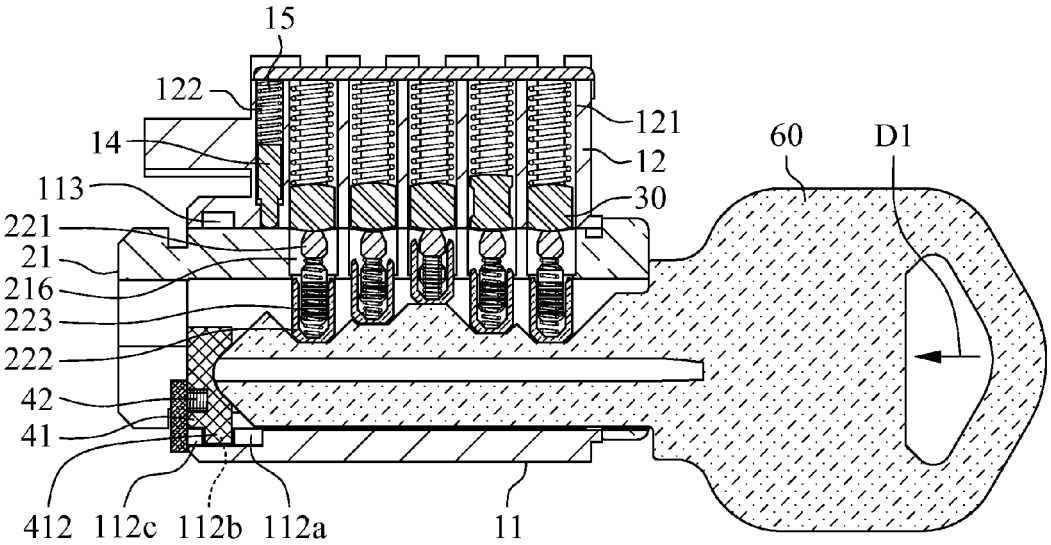
FIG. 9 is a transverse section view illustrating the first matched key is inserted into the rekeyable lock cylinder along B-B line of FIG. 8 in accordance with a preferred embodiment of the present invention.

FIGS. 1, 2 and 9 illustrate a rekeyable lock cylinder in accordance with a preferred embodiment of the present invention, comprising a cylinder body 10, a plug assembly 20 disposed within the cylinder body 10 and a plurality of upper pins 30. A first match key 60 is inserted into the rekeyable lock cylinder for unlock in a first direction D1, and the rekeyable lock cylinder may utilize a rekeying tool 70 for rekeying. The cylinder body 10 comprises a hollow cylinder portion 11 for accommodating the plug assembly 20, an extending protrusion 12 formed at one side of the hollow cylinder portion 11, a resilient assembly 13 disposed at the hollow cylinder portion 11, a location bar 14 and a first spring 15 serving for pushing the location bar 14. Or, the cylinder body 10 may omit manufacturing the extending protrusion 12 in another embodiment. In this embodiment, the hollow cylinder portion 11 has an inside wall 11*a*, an outside wall 11*b*, a recession 111, an axial groove 112 and a radial groove 113, wherein the recession 111, the axial groove 112 and the radial groove 113 are recessed from the inside wall 11*a*. Preferably, the recession 111 communicates with the inside wall 11*a* and the outside wall 11*b*. The axial groove 112 in communication with the radial groove 113 comprises a first limiting area 112*a*, an overlapping area 112*b* and a second limiting area 112*c*, wherein the overlapping area 112*b* is where the axial groove 112 communicates with and intersects the radial groove 113, the first limiting area 112*a* and the second limiting area 112*c* are respectively located at the two sides of the overlapping area 112*b*. The extending protrusion 12 has a plurality of upper pin holes 121 and a straight slot 122 parallel to the upper pin holes 121, the upper pin holes 121 and the straight slot 122 communicate with the hollow cylinder portion 11. Referring to FIGS. 1, 2 and 4, the resilient assembly 13 disposed at the recession 111 of the hollow cylinder portion 11 has a movable plate 131, an immovable plate 132 affixed at the recession 111 of the cylinder body 10 and at least one resilient member 133 disposed between the movable plate 131 and the immovable plate 132. In this embodiment, the movable plate 131 is transversely movable within the recession 111, and two ends of the resilient member 133 contact against the movable plate 131 and the immovable plate 132 respectively. In addition, the location bar 14 and the first spring 15 are disposed within the straight slot 122 of the extending protrusion 12 in this embodiment.

Figure 4A:
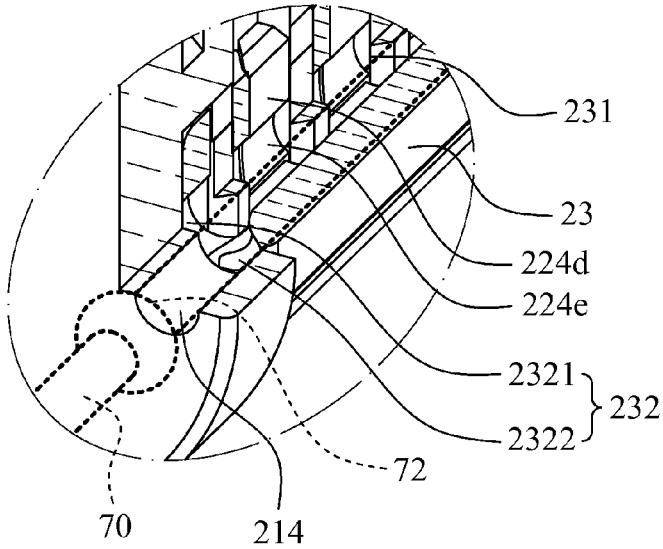
FIG. 4*a* is an enlarged view of the plug assembly of FIG. 4 taken from the encircled dotted line portion of FIG. 4.

Referring to FIGS. 1, 4 and 4*a*, the plug assembly 20 comprises a plug body 21, a plurality of pin assemblies 22 and a guide bar 23 coupled to the plug body 21. The plug body 21 has a longitudinal axis 21*a*, a transverse axis 21*b* perpendicular to the longitudinal axis 21*a*, an outer surface 21*c*, a front portion 211, a middle portion 212, a drive portion 213, a tool-receiving hole 214 penetrating the front portion 211, and a keyhole 215 in communication with the pin holes 216. In this embodiment, the middle portion 212 of the plug body 21 has a plurality of pin holes 216 serving for disposing the pin assemblies 22, a trench 217 communicating with the pin holes 216 and the tool-receiving hole 214, and a catching slot 218, wherein each of the pin holes 216 has a center hole portion 216*a*, a first cavity portion 216*b* formed at one side of the center hole portion 216*a* and a second cavity portion 216*c* formed at another side of the center hole portion 216*a*, besides the first cavity portion 216*b* and the second cavity portion 216*c* are in communication with the center hole portion 216*a*. The trench 217 is parallel disposed relative to the key hole 215 in the longitudinal axis 21*a* or in the first direction D1 (shown in FIG. 9) and comprises a first trench wall 217*a* facing the tool-receiving hole 214, a tool-fixing hole 217*b* recessing into the first trench wall 217*a*, and a second trench wall 217*c*. The rekeying tool 70 comprises a first end 71 and a second end 72, the first end 71 is fixedly inserted into the tool-fixing hole 217*b*, and the second end 72 is inserted into the tool-receiving hole 214. Preferably, the tool-fixing hole 217*b* is opposite to the tool-receiving hole 214.

Referring to FIGS. 1, 1*a*, 1*b*, 1*c*, 1*d*, 1*e*, 4, 6 22 and 23, the pin assemblies 22 are respectively disposed within the pin holes 216 of the plug body 21. In this embodiment, each of the pin assemblies 22 is height-adjustable pins and comprises a first rack component 221 engaged with the guide bar 23, a second rack component 222 selectively engaging with the first rack component 221, and an elastic component 223 disposed between a first rack component 221 and a second rack component 222. The first rack components 221 and the second rack components 222 are accommodated in the pin holes 216. The second rack components 222 are movable via contacting against the first matched key 60. Each of the first rack components 221 has a rib portion 224, an extending portion 225, and a first rack portion 226, wherein the rib portion 224 of the first rack components 221 comprises a top end 224*a*, a front lateral 224*b*, a back lateral 224*c*, and a catching protrusion 224*d* protruding from the back lateral 224*c*. The extending portion 225 is formed extending from the top end 224*a* of the rib portion 224, and the first rack portion 226 is formed on the front lateral 224*b* of the rib portion 224. The extending portion 225 is slideably located in the center hole portion 216*a* of the pin hole 216, and the rib portion 224 is simultaneously located in the center hole portion 216*a* and the first cavity portion 216*b* of the pin hole 216. Each of the second rack components 222 has a main body 227 corresponding to the extending portion 225 of the first rack component 221, a guiding portion 228 formed at one side of the main body 227, and a second rack portion 229 formed at another side of the main body 227. The main body 227 comprises a bottom surface 227*c* in contact against the first matched key 60, and the first rack portion 226 is engaged with the second rack portion 229. The main body 227 and the second rack portion 229 are located in the center hole portion 216*a* of the pin hole 216, and the guiding portion 228 is located in the second cavity portion 216*c* of the pin hole 216.

Referring to FIGS. 1, 1*a*, 1*b*, 1*c*, 1*d*, 1*e* and 5, each of the elastic components 223 has a first end 223*a* contacting against the first rack component 221 and a second end 223*b* contacting against the second rack component 222, in this embodiment, the first ends 223*a* of the elastic components 223 contact against the extending portions 225 of the first rack components 221 respectively, and the second ends 223*b* of the elastic components 223 contact against the main bodies 227 of the second rack components 222 respectively. Preferably, each of the extending portions 225 has a notch 225*a* and an arc surface 225*b*, the first end 223*a* of the elastic component 223 is disposed within the notch 225*a* of the extending portion 225, besides referring to FIGS. 5, 8 and 10, the arc surface 225*b* of the extending portion 225 is capable of selectively flushing with the outer surface 21*c* of the plug body 21. Each of the main bodies 227 has an accommodating cavity 227*a* and a pair of flanks 227*b* formed protruding from a periphery of the accommodating cavity 227*a*, the second end 223*b* of the elastic component 223 is disposed within the accommodating cavity 227*a* of the main body 227, and the flanks 227*b* are corresponding to each other and capable of orientating the elastic component 223.

Referring to FIGS. 1, 3, 4, 9, 22, 23, 24*a* and 24*b*, the guide bar 23 disposed at the trench 217 of the middle portion 212 of the plug body 21 has a first surface 23*c* engaged with the first rack components 221, a second surface 23*d* opposite to the first surface 23*c*, a first side 23*a* in connection with the first surface 23*c* and the second surface 23*d*, a second side 23*b* in connection with the first surface 23*c* and the second surface 23*d*, a plurality of pin runners 231 recessed in the first surface 23*c* of the guide bar 23, and a tool-receiving portion 232 recessed into the first side 23*a*. The first trench wall 217*a* and the second trench wall 217*c* are in contact with the first side 23*a* and the second side 23*b*. The movable plate 131 is capable of contacting against the second surface 23*d* of the guide bar 23. Via transverse movement of the guide bar 23, the resilient assembly 13 actuates the guide bar 23 to return to its original position. The pin runners 231 are served for engaging with the first rack components 221 and comprises a ramp surface 231*a*, a bottom surface 231*b*, and a tip 231*c* formed by the ramp surface 231*a* and the bottom surface 231*b*. The ramp surface 231*a* is in contact against the catching protrusion 224*d*, and the tip 231*c* is faced toward the first side 23*a* of the guide bar 23. The tool-receiving portion 232 has a groove 2321 recessed from the first side 23*a*, a chute 2322 recessed from the first side 23*a* and a tool-contacting surface 232*a* located within the groove 2321, preferably the groove 2321 is in communication with the first side 23*a* and the second side 23*b*. The groove 2321 has a first groove portion 2321*a*, a second groove portion 2321*b* corresponding to the tool-receiving hole 214, and an inner wall 2321*c*. The chute 2322 communicates with the groove 2321 and the tool-contacting surface 232*a* faces the first rack components 221, and preferably the tool-contacting surface 232*a* is part of the inner wall 2321*c*. Besides, a recess 224*e* recessed in the catching protrusion 224*d* is in communication with the pin runners 231 and the groove 2321 of the tool-receiving portion 232.

In this embodiment, the second surface 23*d* is formed in a smooth shape, the tool-receiving portion 232 is parallel to the first direction D1, the second rack components 222 are actuated by said guide bar 23 via acting force applied by the rekeying tool 70 accommodated in the tool-receiving portion 232 therefore enabling the first rack components 221 to move in a transverse direction (like the transverse axis 21*b* shown in FIG. 1) relative to the first direction D1 and disengaging the first rack components 221 from the second rack components 222. Preferably, the guide bar 23 can not move in any directions other than in a transverse direction relative to the first direction D1. The first side 23*a* is faced toward the tool-receiving hole 214, the second side 23*b* is faced toward the drive portion 213, and the tool-receiving portion 232 is opposite to the tool-receiving hole 214. Each of the pin runners 231 is engaged with the rib portion 224 of the first rack component 221, preferably the catching protrusion 224*d* of the rib portion 224 is inserted into each of the pin runners 231. In this embodiment, each of the pin runners 231 is a dovetail slot, and each of the catching protrusions 224*d* is a dovetail base inserted into the dovetail slot. Referring again to FIGS. 1 and 6, the upper pins 30 are configured and disposed to move in the upper pin holes 121 of the extending protrusion 12 of the cylinder body 10 and the pin holes 216 of the middle portion 212 of the plug body 21, wherein at least one of the upper pins 30 is in I shape so as to enhance the anti-thief performance of the rekeyable lock cylinder.

Moreover, referring again to FIGS. 1 and 6, the present invention further comprises a limit assembly 40 disposed at the plug body 21 as to enhance burglar-proofness and security. The limit assembly 40 has a limiting block 41 and a second spring 42 contacting against the limiting block 41. The limiting block 41, disposed at the keyhole 215 of the plug body 21 and adjacent to the drive portion 213, projects from the plug body 21 and corresponds to the axial groove 112 of the hollow cylinder portion 11. In this embodiment, the limiting block 41 can move within the axial groove 112 of the hollow cylinder portion 11 and has a first lateral 41*a*, a chamfer 411 recessed from the first lateral 41*a* and corresponding to the keyhole 215, a second lateral 41*b* opposite to the first lateral 41*a*, a bottom surface 41*c* facing the axial groove 112 and a protrusion 412 projecting from the bottom surface 41*c*. The protrusion 412, also projecting from the plug body 21, is disposed to move within the axial groove 112 of the hollow cylinder portion 11 capable of limiting the plug body 21 not to be turned around. Referring again to FIGS. 1 and 6, the second spring 42 is disposed between the drive portion 213 of the plug body 21 and the limiting block 41 and one end of the second spring 42 contacts against the second lateral 41*b* of the limiting block 41.

In this embodiment, if an unmatched key (not shown in the drawings) is inserted into the keyhole 215 of the plug body 21 with opportune beat and turn for unlocking in a locked condition, it merely makes that the protrusion 412 of the limiting block 41 moves from the first limiting area 112*a* of the axial groove 112 to the second limiting area 112*c*. Meantime, despite the upper pins 30 or the pin assemblies 22 cannot limit the plug body 21 not to be turned around, but the protrusion 412 still can limit the plug body 21 not to be turned around. The present invention also utilizes the limiting block 41 and the second spring 42 to strength lock cylinder structure and increases unlocking difficulty for an unmatched key, thereby widely enhancing burglar-proofness and security of the lock cylinder structure.

Figure 7:
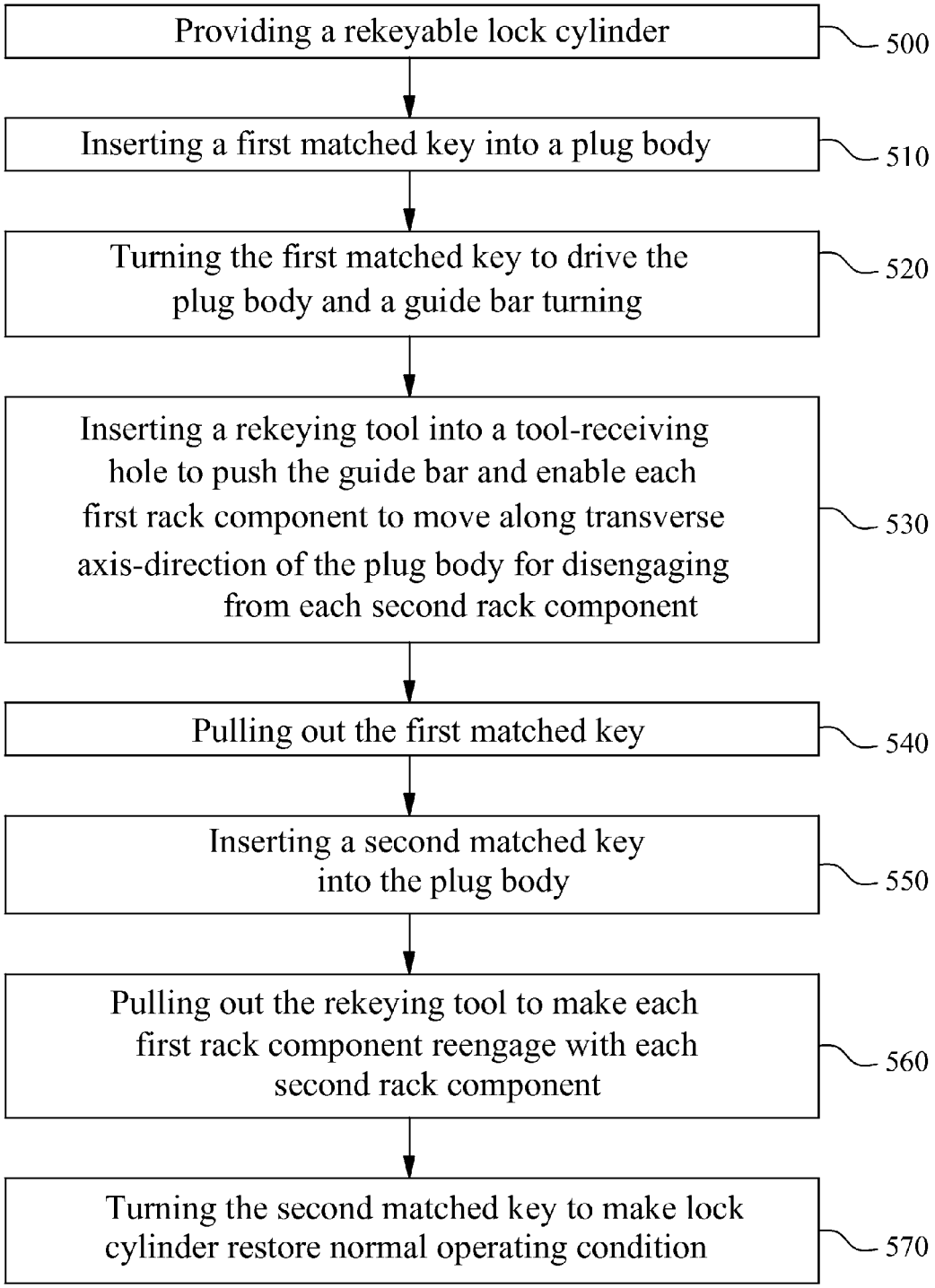
FIG. 7 is a flow chart for rekeying method of the rekeyable lock cylinder in accordance with a preferred embodiment of the present invention.

FIG. 7 illustrates rekeying method of the rekeyable lock cylinder comprising "providing a rekeyable lock cylinder" step 500, "inserting a first matched key into a plug body" step 510, "turning the first matched key to drive the plug body and a guide bar turning" step 520, "inserting a rekeying tool into a tool-receiving hole to push the guide bar and enable each first rack component to move along transverse axis-direction of the plug body for disengaging from each second rack component" step 530, "pulling out the first matched key" step 540, "inserting a second matched key into the plug body" step 550, "pulling out the rekeying tool to make each first rack component reengage with each second rack component" step 560 and "turning the second matched key to make lock cylinder restore normal operating condition" step 570.

Figure 5:
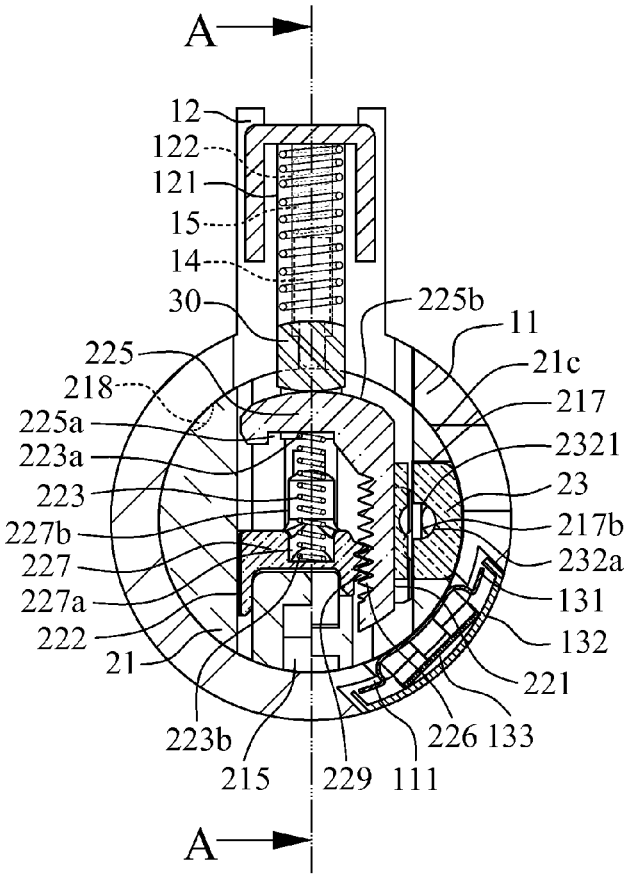
FIG. 5 is an assembled longitudinal section view illustrating the rekeyable lock cylinder in accordance with a preferred embodiment of the present invention.
Figure 6:
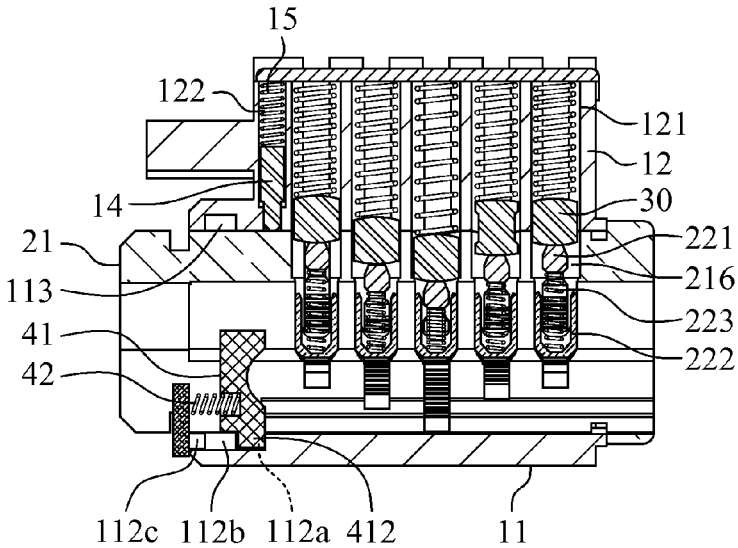
FIG. 6 is a transverse section view illustrating the rekeyable lock cylinder along A-A line of FIG. 5 in accordance with a preferred embodiment of the present invention.

Initially, referring to FIGS. 2, 5 and 6, "providing a rekeyable lock cylinder" step 500 is performed, in which the rekeyable lock cylinder is composed by assembling the cylinder body 10, the plug assembly 20 and the upper pins 30. In this embodiment, the tool-receiving hole 214 corresponds to the second groove portion 2321*b* of the groove 2321 and there is a condition that the first rack components 221 are in engagement with the second rack components 222.

Figure 8:
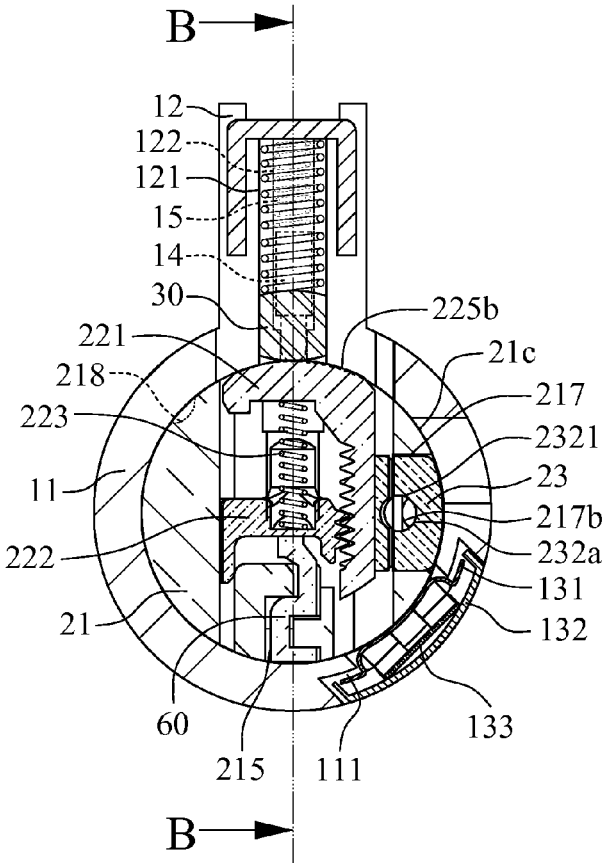
FIG. 8 is a longitudinal section view illustrating the first matched key is inserted into the rekeyable lock cylinder in accordance with a preferred embodiment of the present invention.

Next, referring to FIGS. 7, 8 and 9, "inserting a first matched key into a plug body" step 510 is performed, in which a first matched key 60 is inserted into the keyhole 215 of the plug body 21 and pushes the pin assemblies 22 upwardly move to turning interface in this embodiment, wherein the arc surface 225*b* of the extending portion 225 is flushed with the outer surface 21*c* of the plug body 21.

Figure 10:
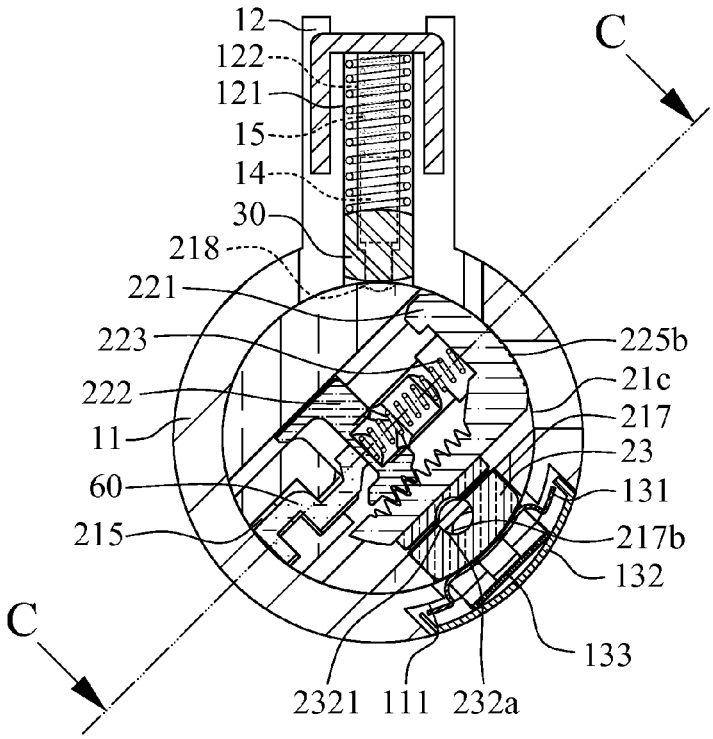
FIG. 10 is a longitudinal section view illustrating the first matched key is turned 45-degrees clockwise in accordance with a preferred embodiment of the present invention.
Figure 11:
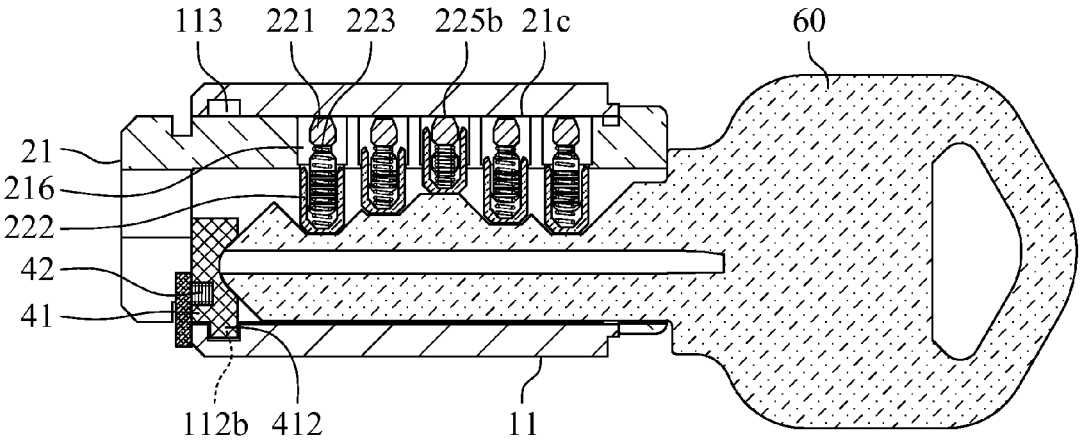
FIG. 11 is a transverse section view illustrating the first matched key is turned 45-degrees clockwise along C-C line of FIG. 10 in accordance with a preferred embodiment of the present invention.
Figure 12:
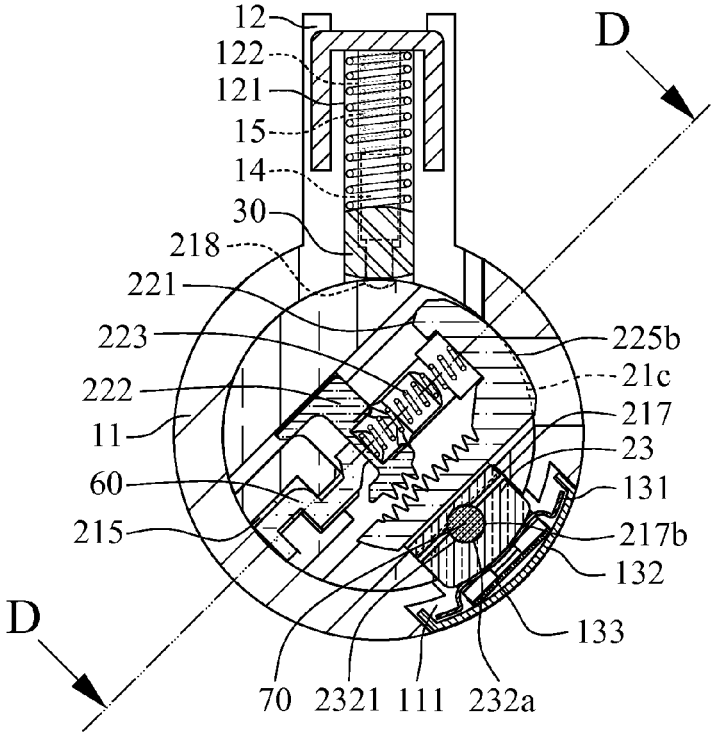
FIG. 12 is a longitudinal section view illustrating the rekeying tool is inserted into the rekeyable lock cylinder in accordance with a preferred embodiment of the present invention.
Figure 13:
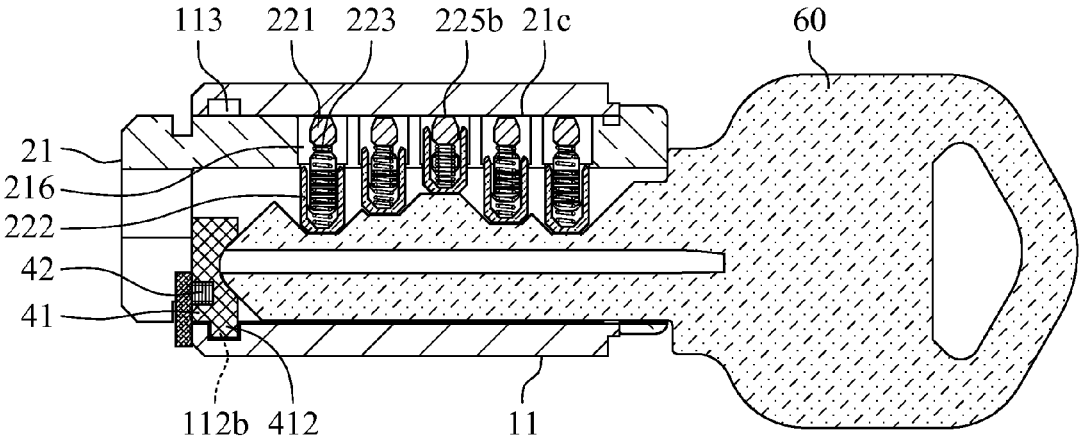
FIG. 13 is a transverse section view illustrating the rekeying tool is inserted into the rekeyable lock cylinder along D-D line of FIG. 12 in accordance with a preferred embodiment of the present invention.

Next, referring to FIGS. 7, 10 and 11, "turning the first matched key to drive the plug body and a guide bar turning" step 520 is performed, in which the first matched key 60 is turned to drive the plug body 21 and the guide bar 23 turning to a predetermined angular position and the first matched key 60 is turned about 45-degrees clockwise in this embodiment. Meantime, the catching slot 218 of the middle portion 212 of the plug body 21 corresponds to the location bar 14 that allows the location bar 14 be caught by the catching slot 218, and the plug body 21, the guide bar 23 and the pin assemblies 22 are limited at 45-degrees position by the location bar 14, wherein the guide bar 23 corresponds to the recession 111 of the hollow cylinder portion 11 and the resilient assembly 13 and contacts against the movable plate 131 of the resilient assembly 13.

Next, referring to FIGS. 1, 3, 7, 12 and 13, "inserting a rekeying tool into a tool-receiving hole to push a tool-receiving portion of the guide bar and enable each first rack component to move along transverse axis-direction of the plug body for disengaging from each second rack component" step 530 is performed, in which a rekeying tool 70 is inserted into the tool-receiving hole 214 of the plug body 21. Meantime, the rekeying tool 70 pushes the tool-contacting surface 232*a* of the tool-receiving portion 232 of the guide bar 23 for allowing the guide bar 23 to move to the resilient assembly 13. In this embodiment, the rekeying tool 70 first contacts against the chute 2322 of the tool-receiving portion 232 and then slides into the groove 2321 of the tool-receiving portion 232 along the chute 2322 and contacts against the tool-contacting surface 232*a*. When the rekeying tool 70 penetrates the groove 2321 of the tool-receiving portion 232, it pushes the guide bar 23 moving along transverse axis-direction (like the transverse axis 21*b* shown in FIG. 1) of the plug body 21 and the movable plate 131 of the resilient assembly 13 is pushed by the guide bar 23 moving to the immovable plate 132 and compresses the resilient member 133. In this embodiment, a space needed for the guide bar 23 to move in can be provided by that the movable plate 131 moves away. Besides, the guide bar 23 moves to drive each of the first rack components 221 moving along transverse axis-direction of the plug body 21 capable of disengaging each of the first rack components 221 from each of the second rack components 222 and meantime the tool-receiving hole 214 corresponds to the first groove portion 2321*a* and the second groove portion 2321*b* of the groove 2321. In addition, the rekeying tool 70 is inserted into the tool-fixing hole 217*b* in this embodiment for affixing the guide bar 23 and the first rack components 221.

Figure 14:
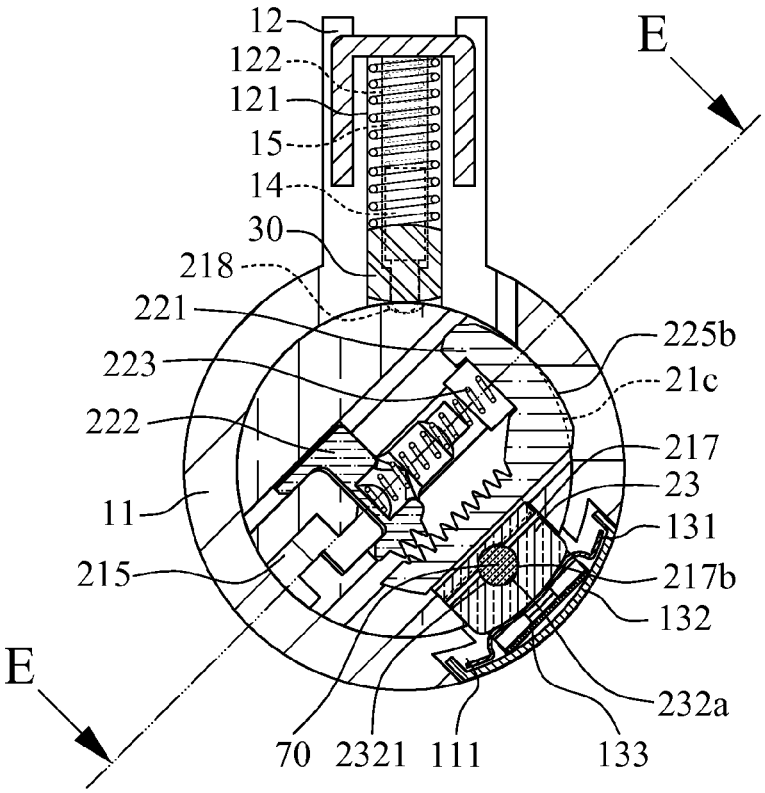
FIG. 14 is a longitudinal section view illustrating the first matched key is pulled out in accordance with a preferred embodiment of the present invention.
Figure 15:
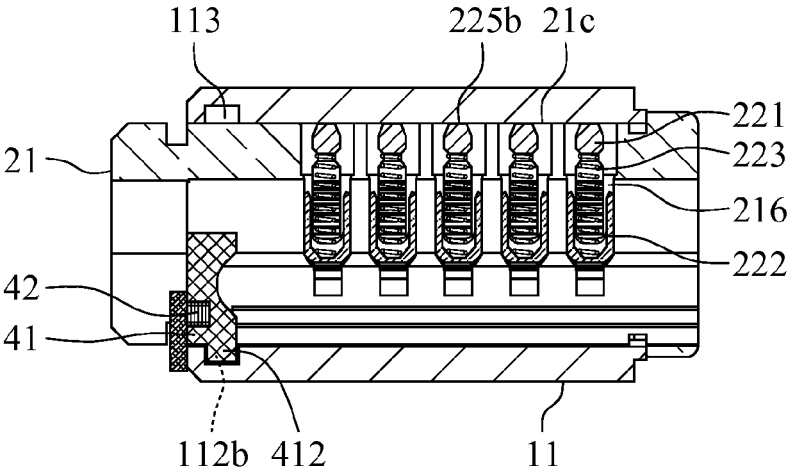
FIG. 15 is a transverse section view illustrating the first matched key is pulled out along E-E line of FIG. 14 in accordance with a preferred embodiment of the present invention.
Figure 16:
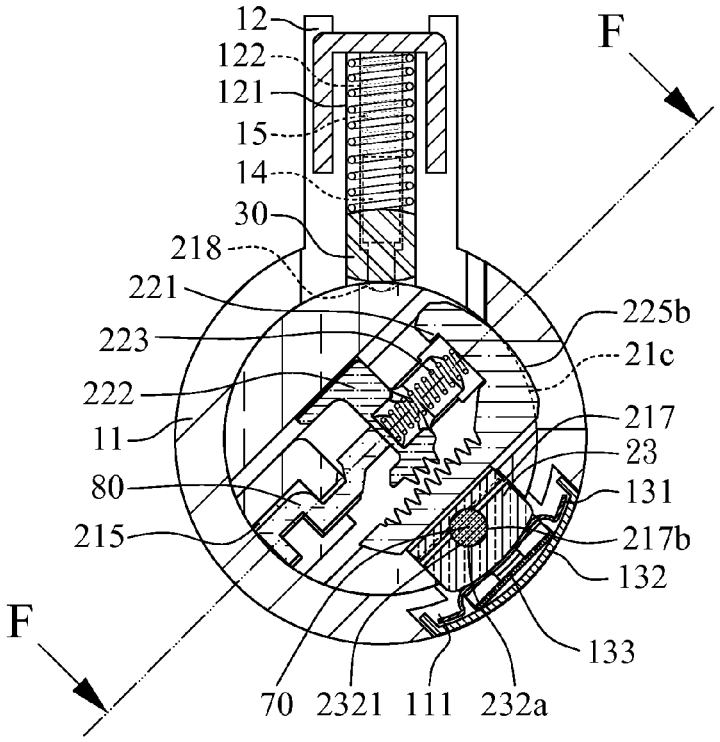
FIG. 16 is a longitudinal section view illustrating the second matched key is inserted into the rekeyable lock cylinder in accordance with a preferred embodiment of the present invention.
Figure 17:
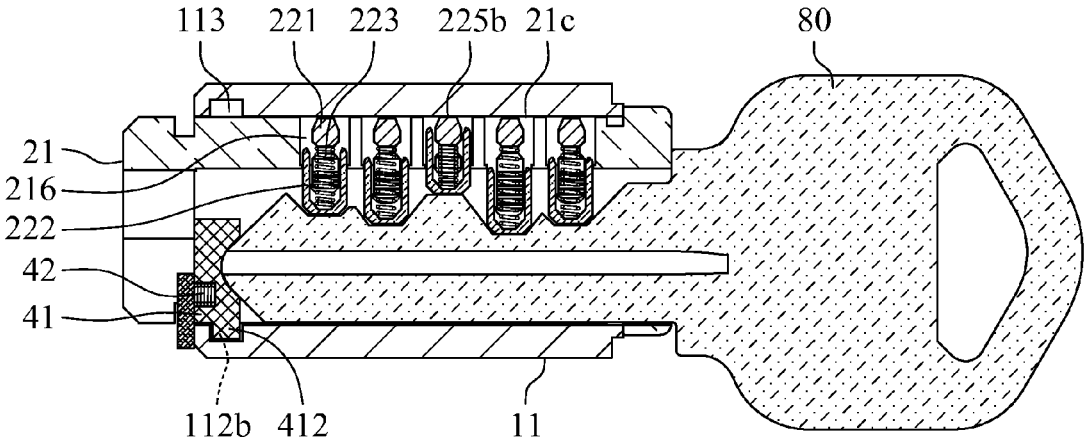
FIG. 17 is a transverse section view illustrating the second matched key is inserted into the rekeyable lock cylinder along F-F line of FIG. 16 in accordance with a preferred embodiment of the present invention.

Next, referring to FIGS. 7, 14 and 15, "pulling out the first matched key" step 540 is performed, in which the first matched key 60 is pulled out. When the first matched key 60 is pulled out in this embodiment, the second rack components 222 of the pin assemblies 22 are pushed by the elastic components 223 to fall to lowermost position. Next, referring to FIGS. 7, 16 and 17, "inserting a second matched key into the plug body" step 550 is performed, in which a second matched key 80 is inserted into the keyhole 215 of the plug body 21 and the second rack components 222 of the pin assemblies 22 in this embodiment will readjust height in accordance with different height of bitting of the second matched key 80.

Figure 18:
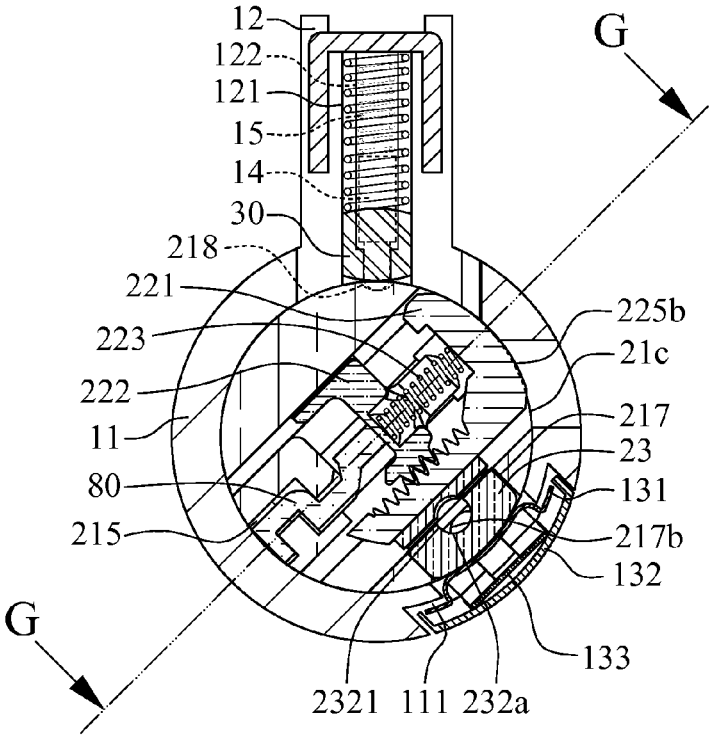
FIG. 18 is a longitudinal section view illustrating the rekeying tool is pulled out in accordance with a preferred embodiment of the present invention.
Figure 19:
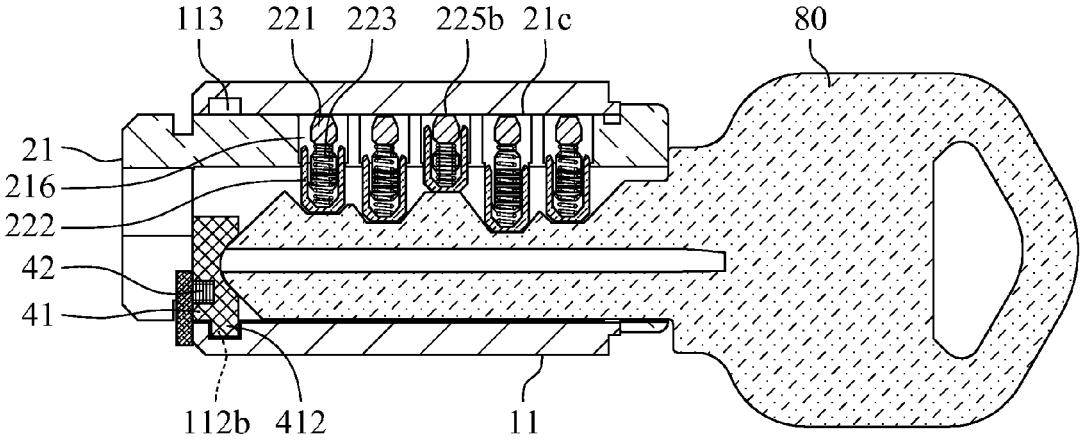
FIG. 19 is a transverse section view illustrating the rekeying tool is pulled out along G-G line of FIG. 18 in accordance with a preferred embodiment of the present invention.

Next, referring to FIGS. 7, 18 and 19, "pulling out the rekeying tool to make each first rack component reengage with each second rack component" step 560 is performed, in which the rekeying tool 70 is pulled out and meantime the guide bar 23 is pushed by the resilient member 133 of the resilient assembly 13 to restore and drive the first rack components 221 to reengage with the second rack components 222.

Figure 20:
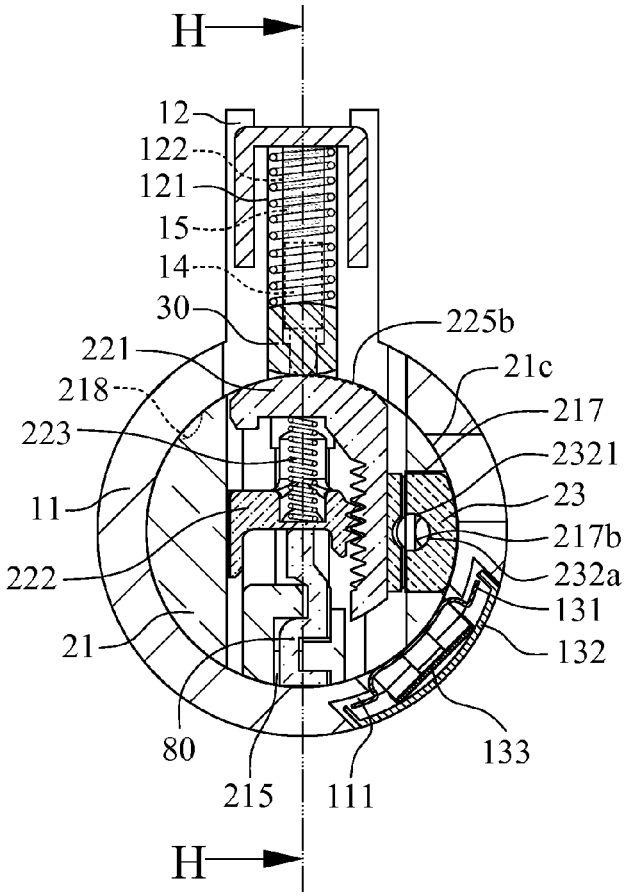
FIG. 20 is a longitudinal section view illustrating the rekeyable lock cylinder in normal service condition in accordance with a preferred embodiment of the present invention.
Figure 21:
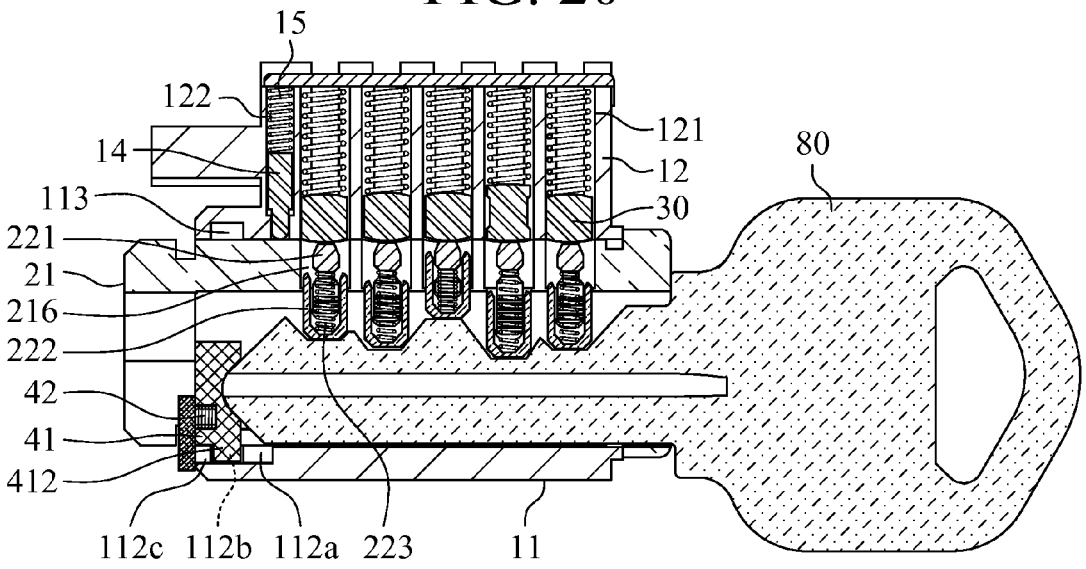
FIG. 21 is a transverse section view illustrating the rekeyable lock cylinder in normal service condition along H-H line of FIG. 20 in accordance with a preferred embodiment of the present invention.
Figure 22:
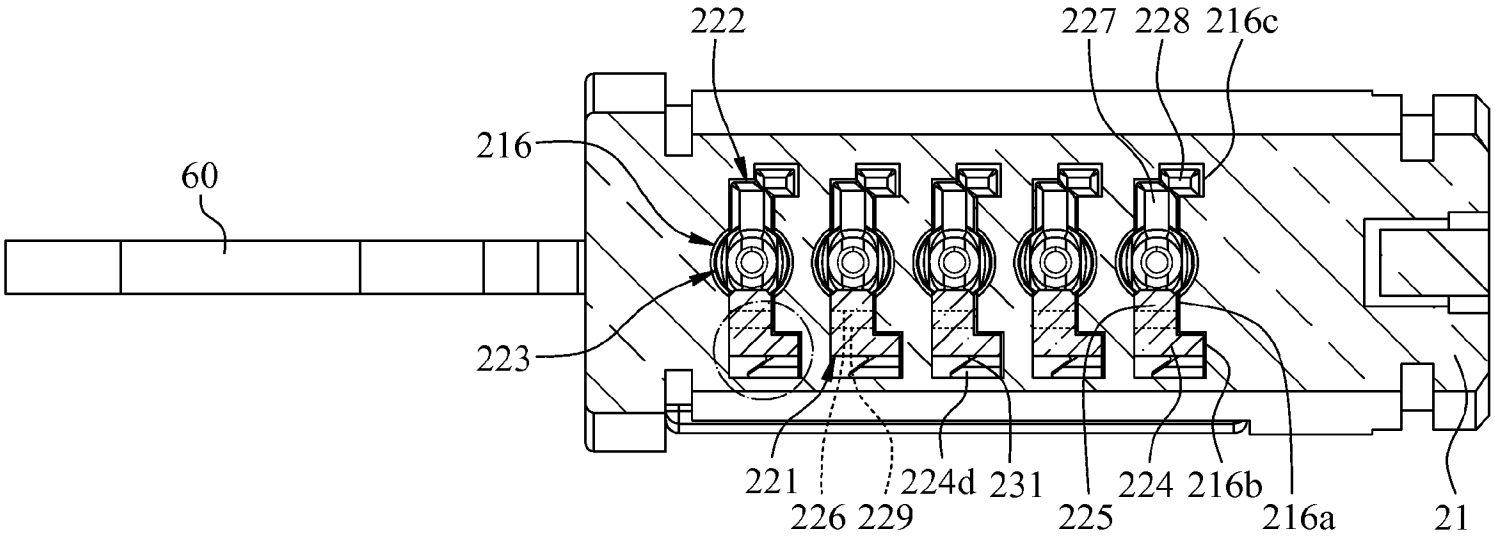
FIG. 22 is a cross-section view illustrating the plug assembly in accordance with a preferred embodiment of the present invention.
Figure 22A:
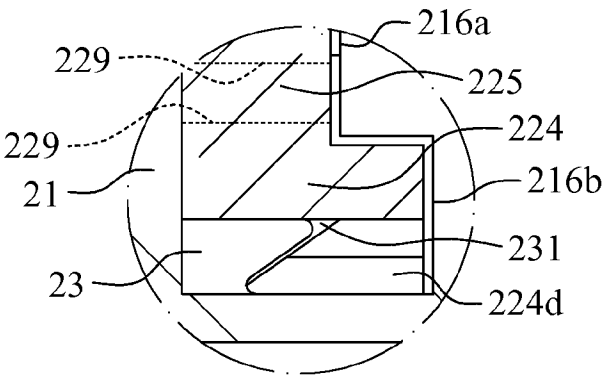
FIG. 22*a* is an enlarged view of the plug assembly of FIG. 22 taken from encircled dotted line portion of FIG. 22.
Figure 23:
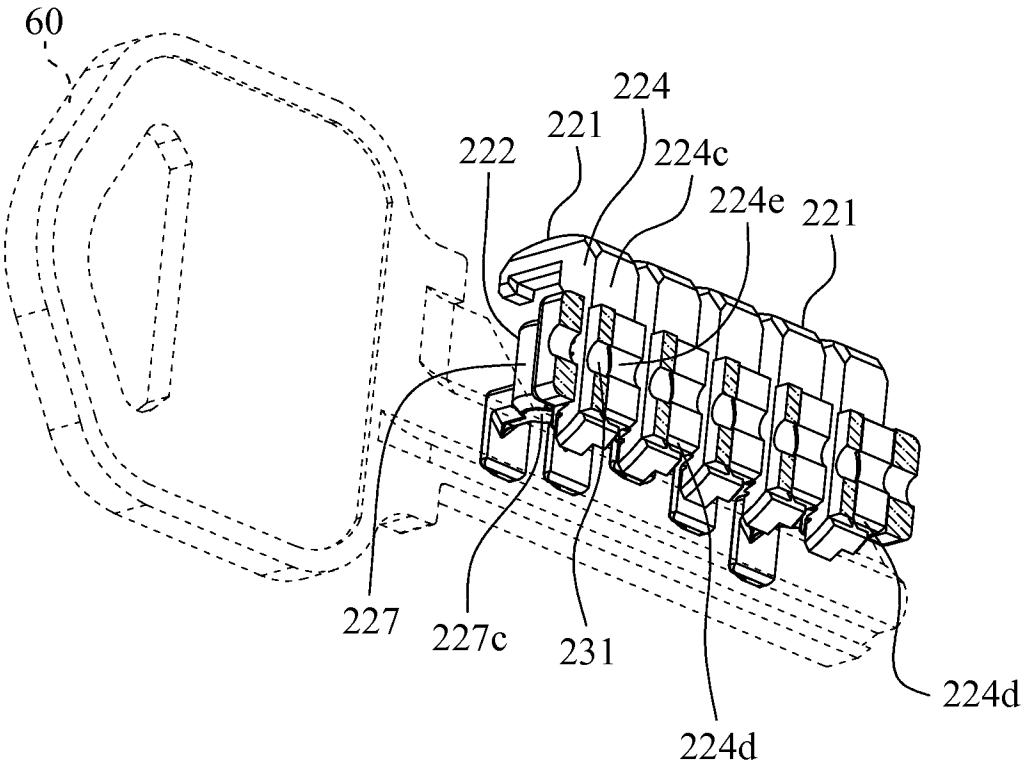
FIG. 23 is a partial perspective assembly view illustrating the rekeyable lock cylinder in accordance with a preferred embodiment of the present invention.
Figure 24A:
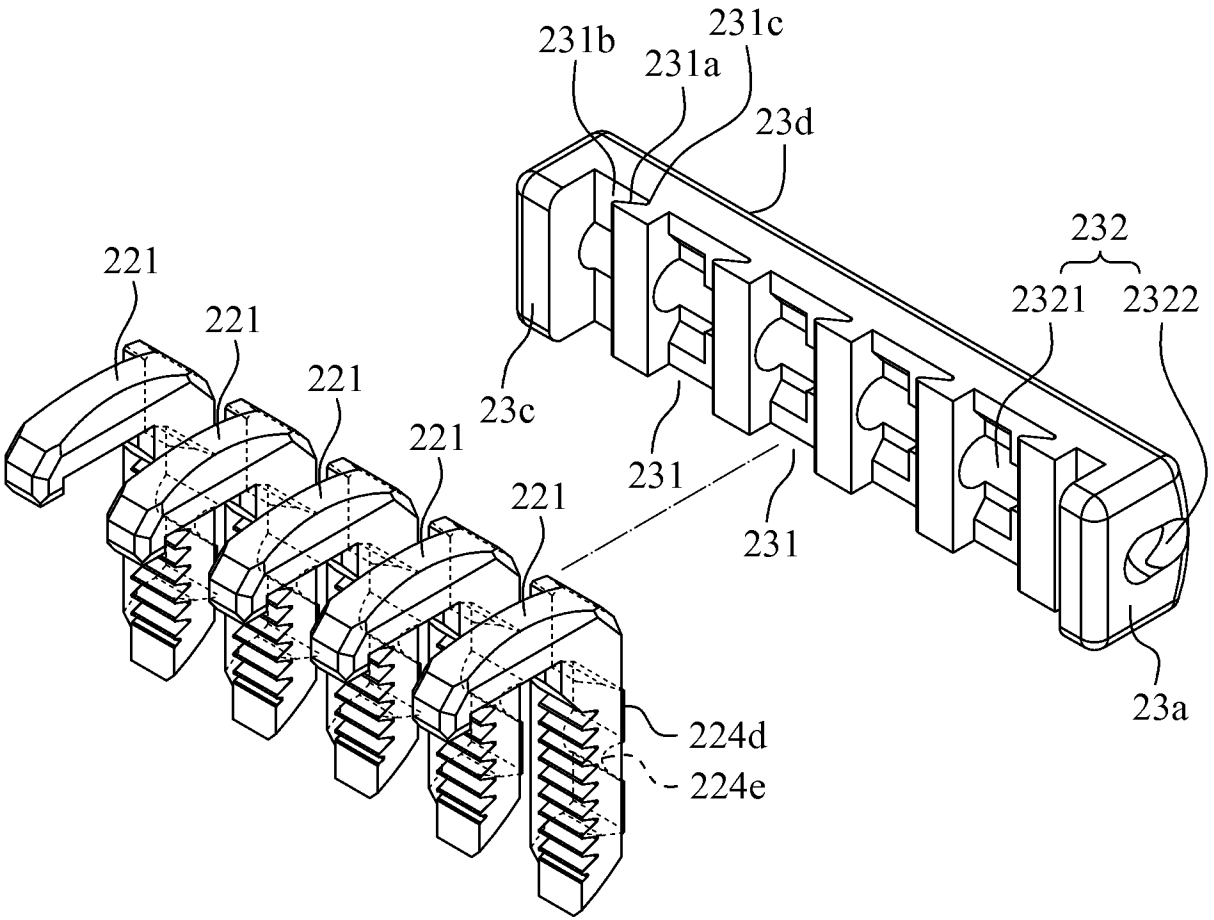
FIG. 24*a* is a partial perspective exploded view illustrating the rekeyable lock cylinder in accordance with a preferred embodiment of the present invention.
Figure 24B:
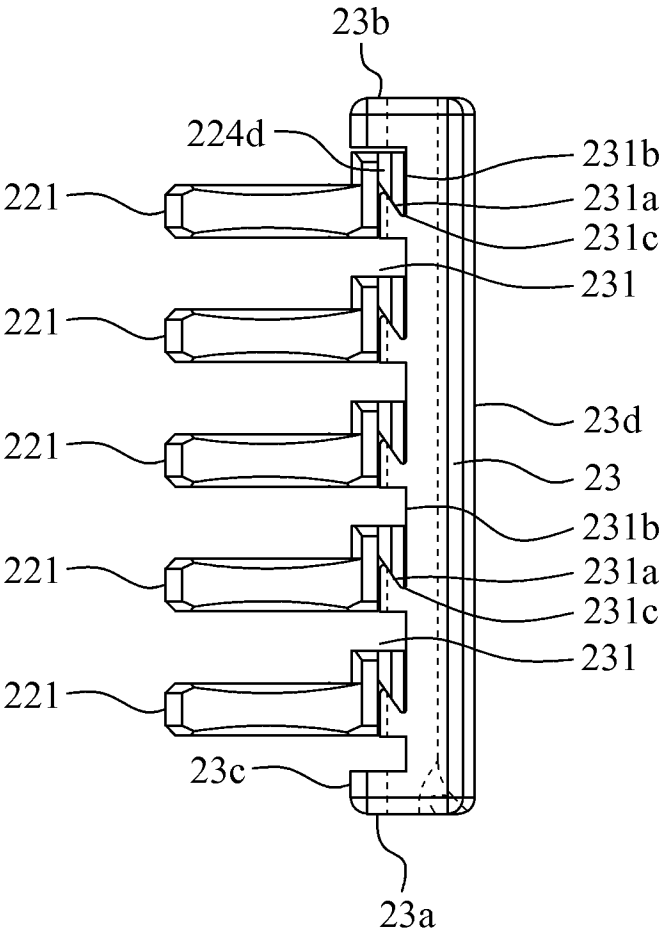
FIG. 24*b* is another partial perspective exploded view illustrating the rekeyable lock cylinder in accordance with a preferred embodiment of the present invention.

Finally, referring to FIGS. 7, 20 and 21, "turning the second matched key to make lock cylinder restore normal operating condition" step 570 is performed, in which the second matched key 80 is turned to make the rekeyable lock cylinder restore normal operating condition.

While the present invention has been particularly illustrated and described in detail with respect to the preferred embodiments thereof, it will be clearly understood by those skilled in the art that various changes in form and details may be made without departing from the spirit and scope of the present invention.

What is claimed is:

1. A rekeyable lock cylinder comprising:

a plurality of first rack components;

a plurality of second rack components selectively engaged with the first rack components and movable via contacting against a first matched key which is inserted in a first direction, when the first matched key is inserted in the rekeyable lock cylinder; and a guide bar having a first surface engaged with the first rack components, a second surface opposite to the first surface, a first side in connection with the first surface and the second surface, a second side in connection with the first surface and the second surface, and a tool-receiving portion recessed into the first side, wherein the second surface is formed in a smooth shape, the tool-receiving portion is parallel to the first direction, and the first rack components are actuated by said guide bar via acting force applied by a rekeying tool accommodated in the tool-receiving portion, when the rekeying tool is inserted in the tool-receiving portion, therefore enabling the first rack components to move in a transverse direction relative to the first direction and disengaging the first rack components from the second rack components.

2. The rekeyable lock cylinder in accordance with claim 1, wherein each of the first rack components has a rib portion and a first rack portion, the rib portion comprises a front lateral, and the first rack portion is formed on the front lateral.

3. The rekeyable lock cylinder in accordance with claim 2, wherein each of the second rack components has a main body and a second rack portion formed at another side of the main body, the main body comprises a bottom surface, and the first rack portion is engaged with the second rack portion.

4. The rekeyable lock cylinder in accordance with claim 2, wherein a plurality of pin runners are recessed in the first surface of the guide bar, the rib portion of the first rack components comprises a back lateral and a catching protrusion protruding from the back lateral, and the catching protrusion is inserted into a pin runner.

5. The rekeyable lock cylinder in accordance with claim 4, wherein each of the pin runners is a dovetail slot, and each of the catching protrusions is a dovetail base inserted into the dovetail slot.

6. The rekeyable lock cylinder in accordance with claim 4, wherein each of the pin runners comprises a ramp surface, a bottom surface, and a tip formed by the ramp surface and the bottom surface, the ramp surface is in contact against the catching protrusion, and the tip is faced toward the first side of the guide bar.

7. The rekeyable lock cylinder in accordance with claim 4, wherein a recess recessed in the catching protrusion is in communication with the pin runners and the tool-receiving portion.

8. The rekeyable lock cylinder in accordance with claim 1 further comprises a plug body having a plurality of pin holes, a key hole in communication with the pin holes, and a trench in communication with the pin holes, wherein the first rack components and the second rack components are accommodated in the pin holes, and the trench.

9. The rekeyable lock cylinder in accordance with claim 8, wherein the trench of the plug body comprises a first trench wall and a second trench wall, the first trench wall and the second trench wall are in contact with the first side and the second side.

10. The rekeyable lock cylinder in accordance with claim 9, wherein the plug body further comprises a tool-receiving hole opposite to the tool-receiving portion.

11. The rekeyable lock cylinder in accordance with claim 10, wherein a tool-fixing hole opposite to the tool receiving hole is recessed into the first trench wall.

12. The rekeyable lock cylinder in accordance with claim 11, wherein the rekeying tool comprises a first end and a second end, the first end is fixedly inserted into the tool-fixing hole, and the second end is inserted into the tool-receiving hole.

13. The rekeyable lock cylinder in accordance with claim 1 further comprises a plurality of elastic components, and each of the elastic components is disposed between a first rack component and a second rack component.

14. The rekeyable lock cylinder in accordance with claim 1 further comprises a cylinder body and a resilient assembly, wherein the cylinder body has a recession, and the resilient assembly is disposed at the recession and actuates the guide bar to return to its original position via transverse movement of the guide bar.

15. The rekeyable lock cylinder in accordance with claim 14, wherein the resilient assembly has a movable plate capable of contacting against the second surface of the guide bar, an immovable plate affixed at the cylinder body and a resilient member disposed between the immovable plate and the movable plate.

* * * * *